United States Patent [19]

Atsuta

[11] 3,946,635

[45] Mar. 30, 1976

[54] UPRIGHT PIANO ACTION

[75] Inventor: Masayuki Atsuta, Hamamatsu, Japan

[73] Assignee: Nippon Gakki Seizo Kabushiki Kaisha, Hamamatsu, Japan

[22] Filed: Dec. 13, 1974

[21] Appl. No.: 472,998

[52] U.S. Cl. ..... 84/242

[51] Int. Cl.[2] ..... G10C 3/18

[58] Field of Search ..... 84/242, 253, 240, 241, 84/236, 452 P

[56] References Cited

UNITED STATES PATENTS 3,583,271 6/1971 Corwin et al. ..... 84/452 P X

FOREIGN PATENTS OR APPLICATIONS 19,840 4/1913 United Kingdom ..... 84/242

20,541 7/1915 United Kingdom ..... 84/242

*Primary Examiner*—John Gonzales

[57] ABSTRACT

An upright piano action includes a butt having a hammer, and a jack adapted to swing the butt, thereby permitting the hammer to strike a string, in which there is provided a butt spring means urging against the swinging movement of the hammer toward the string, the butt spring means not acting during the initial portion of the swinging movement of the hammer but acting from midway of the swinging movement thereof up to the point wherein the hammer strikes the string, so that a rapid, continual hammer striking operation is possible, attaining a delicate sound control as with the grand piano action.

7 Claims, 10 Drawing Figures

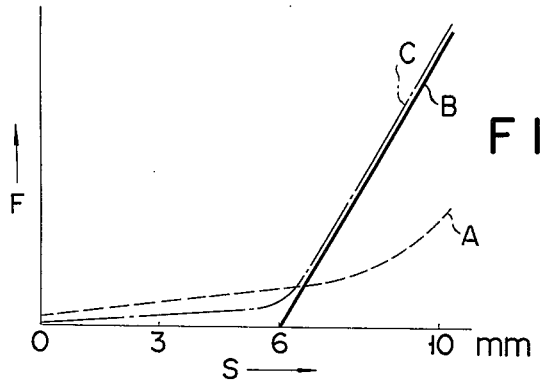
FIG. 4
FIG. 6
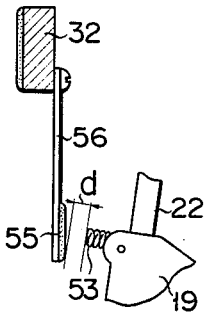
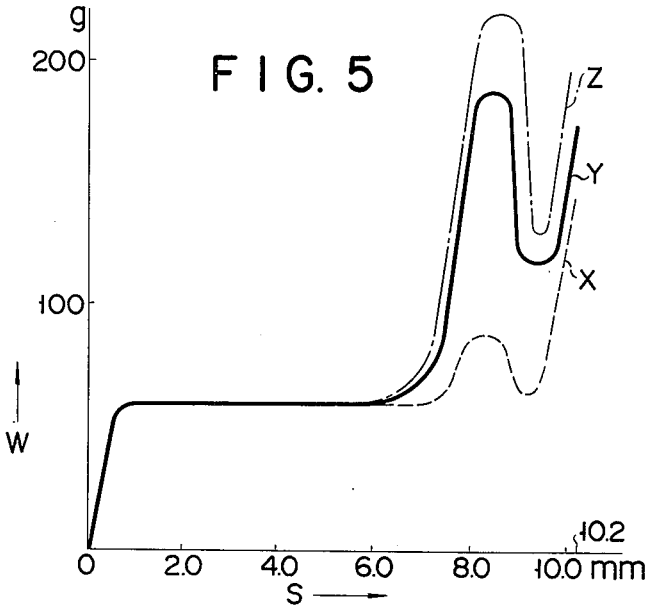
FIG. 5
FIG. 7
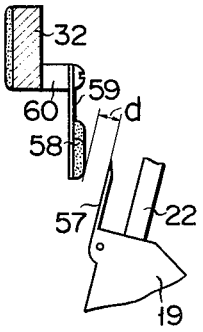
FIG. 8A
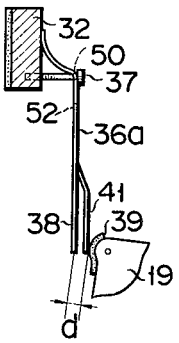
FIG. 8B
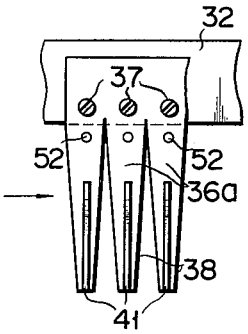

UPRIGHT PIANO ACTION

This invention relates to an upright piano action.

Generally, an upright piano has a plurality of piano actions each corresponding to a key. FIG. 1 shows a coventional upright piano action of this type. The piano action has a wippen 13 swingably mounted to a common main rail 11 extending in a transversal direction of the piano. The wippen is adapted to be swung upward through a capstan button 14 connected to each key K. On the upper side of the wippen is provided a swingable jack 16 which is urged by a compression spring 21 in one swinging direction.

The piano action has a butt 19 swingably mounted to the main rail above the jack. A hammer 23 for striking a string 24 is projected from the top of the butt. At the lower surface of the butt is provided a butt felt 20 adapted to be engaged with the top end of the jack. At the upper portion of the string side of the butt is provided a butt spring wire 26 whose free end is retained by a cloth band 25 provided at a butt flange 17. The butt spring wire normally urges the butt so as to keep the hammer away from the string.

With the upright piano action of this type, when the key K is operated by a player, the wippen 13 is swung by the capstan button 14 to cause the jack 16 to be moved substantially in a vertical direction. The jack pushes the butt upward to cause the hammer 23 to be swung toward the string 24. During the latter half of the key operation, the jack frictionally slides on the butt felt and is disengaged from the lower portion of the butt. Immediately before the jack is disengaged from the butt, a sudden large load is applied to the jack, and after disengagement of the jack from the butt the load abruptly becomes smaller. The change of the load is transmitted to the key K and sensed by the player as a sudden increase and decrease of a piano touch load. Such a sudden change of the piano touch load is usually called "after touch" and the player controls the strength of a delicate sound based on the "after touch". The hammer continues to be swung under an inertial force after the jack is disengaged from the butt, and strikes the string. The butt spring 26 urges the butt normally away from the string, and, after the hammer strikes the string, assuredly urges the butt and thus the hammer away from the string, thereby preventing the hammer for doubly striking the string with one key operation. When the player begins to release the key, the butt 19 is returned, together with the hammer 23, to a rest position by means of the butt spring. On the other hand, the jack 16 is returned, by means of the compression spring, to the initial position where it is abutted against the butt felt.

With the conventional upright piano, since the butt spring 26 always exerts a force on the butt 19, particularly in the case of a continual, rapid key operation, the jack 16 is often prevented by the spring from being returned sufficiently to the initial position under the butt and is unable to effectively push the lower part of the butt upwardly. For this reason, the string is not struck in accordance with the number of the key depressions and the player's intention can not completely be expressed. Furthermore, since the force of the butt spring is relatively slight, a small rise of the "after touch" results and the player can not control the stress of a sound according to his intention. To obtain a great rise of the "after touch", it is considered helpful to strengthen the force of the butt spring. In this case, however, the strong force of the spring prominently prevents the jack from being returned to the initial position where it is abutted against the lower portion of the butt, thus making a continual, rapid string striking almost impossible.

In the grand piano, since a hammer of each piano action is disposed substantially in a horizontal direction and swung from downward to upward by the key operation, it returns to the rest position only due to the weight of the hammer per se and to the reaction of the spring, allowing the jack to be returned assuredly to its initial position under the butt. Accordingly, a great rise of "after touch" can be attained and a continual, rapid hammer striking is made possible by the key operation. This means that the player can control the strength of a sound delicately and accurately.

It is accordingly the object of this invention to provide an upright piano action capable of effecting continual, rapid string strikings by a hammer and attaining "after touch" of the extent substantially equal to that of a grand piano.

An upright piano action according to this invention includes a swingable butt having a hammer for striking a string and a jack adapted to be abutted against the butt in accordance with key operation and then throw off the latter to permit the hammer to be moved from a stationary position to a string striking position, in which there is provided a butt spring means adapted to apply to the butt a force for returning the hammer to the rest position during the hammer is moved between an intermediate position occupied midway of its stroke and a string striking position and to apply no force to the butt when the hammer is moved between the intermediate position and the rest position.

It this upright piano action, since no force of the spring means is applied to the butt during the hammer is moved between said intermediate position and the rest position, the jack can be very easily and accurately returned to the initial position, and thus the spring means can be so designed to have a sufficiently strong force. Consequently, a great rise of "after touch" can be attained and it is, therefore, possible to control the strength of a delicate sound.

The butt spring means may have one end fixed to a fixed member secured to a piano frame and the other end spaced a predetermined amount away from the butt. Or the butt spring means may have one end secured to the butt and the other end spaced a predetermined amount from the fixed member. In this case, a damper rail can be utilized as such a fixed member.

The butt spring means may be leaf spring or compression spring.

This invention will be further explained by reference to the accompanying drawings, in which:

FIG. 4 is a graphical representation showing a relation between a force F of a butt spring applied to a butt and the extent S to which a key is depressed;

FIG. 5 is a graphical representation showing a relation between a load W applied to the key by a piano action and the extent S to which the key is depressed;

FIGS. 6 and 7 are enlarged views showing second and third embodiments, respectively, similar to FIG. 3A;

FIG. 8A is an enlarged view showing a fourth embodiment; and

FIG. 8B is a side view of FIG. 8A.

Figure 1:
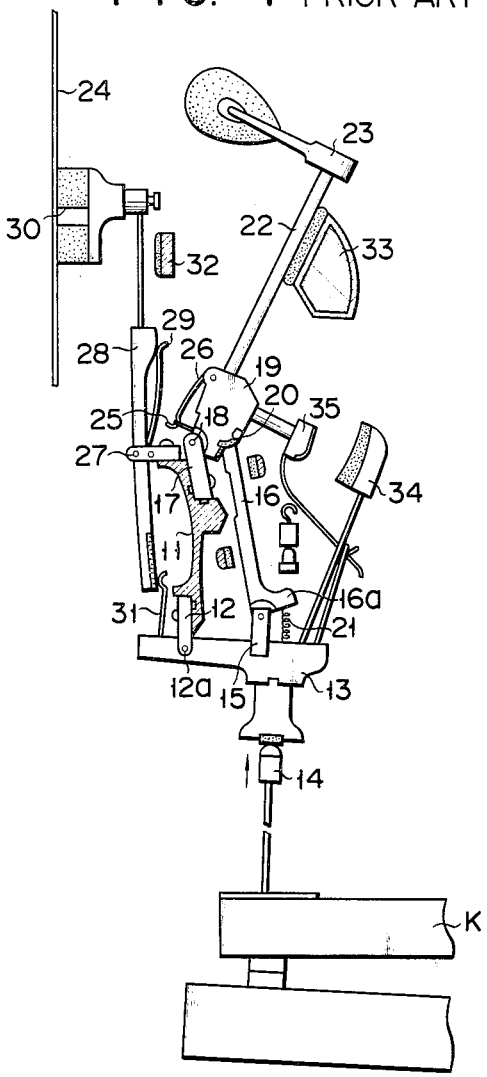
FIG. 1 PRIOR ART
FIG. 1 is a side elevational view showing a conventional upright piano action.
Figure 2:
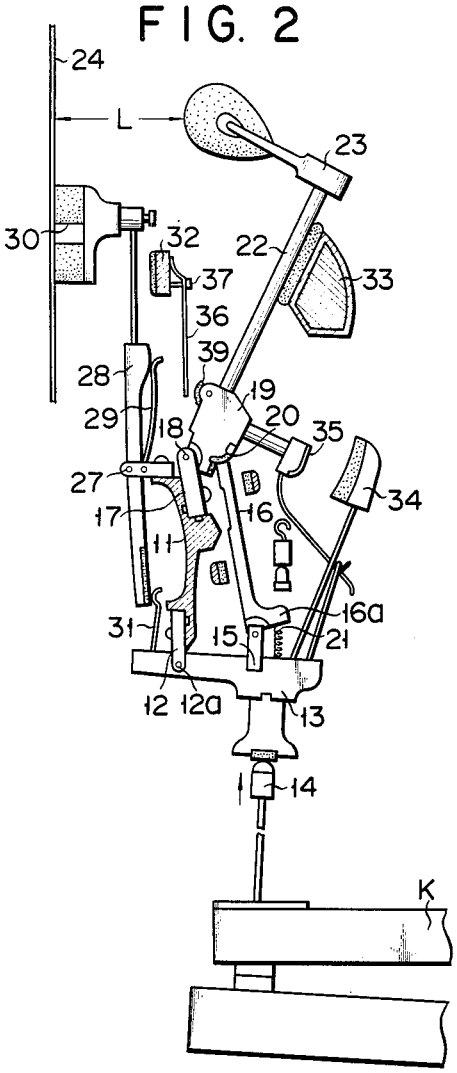
FIG. 2 is a side elevational view showing one embodiment of an upright piano according to this invention.

FIG. 2 shows one of piano actions according to this invention disposed on a main rail 11 which is secured to a piano frame and extends in a transversal direction of a piano. The piano action has a wippen 13 whose one end is swingably mounted through a wippen flange 12 to the main rail. Below the other end portion of the wippen, there is provided a capstan button 14 which is raised by operating a key K (only one part is shown) to cause the wippen 13 to be swung in a counterclockwise direction about a pivot 12*a*. Above the wippen, a jack 16 is swingably mounted through a jack flange 15 to be moved in a substantially vertical direction in accordance with the movement of the wippen. A compression spring 21 stretched between the wippen and a projection 16*a* of the jack normally urges the jack in the counterclockwise direction of FIG. 2.

On the main rail 11, a butt 19 swingable about a pivot 18 is mounted through a butt flange 17. The butt 19 has at its lower side portion an inclined surface on which a butt felt 20 is mounted. The jack 16 has a top surface abutted against the butt felt. On the upper portion of the butt is integrally secured a hammer shank 22 having a hammer 23. The hammer is abruptly moved in a counterclockwise direction during the operation of the key as will be later described to strike a string 24 (only one portion is shown).

On the main rail 11 a damper lever 28 is swingably connected through a damper flange 27. A string damper 30 provided at the upper end of the damper lever is urged in a counterclockwise direction by means of a spring 29 to press the string 24, and adapted to be moved in a clockwise direction, during the operation of the key, by a damper spoon 31 provided on the wippen 13 so that it is released from the string.

Figure 3A:
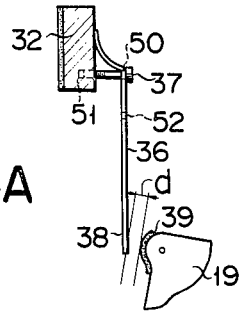
FIG. 3A is an enlarged view showing a butt spring means of FIG. 2.
Figure 3B:
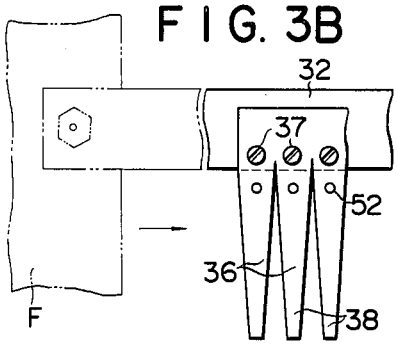
FIG. 3B is a side view of FIG. 3A.

A damper rail 32 is a lengthwise member secured to the piano frame F (FIG. 3B) and adapted to limit the clockwise movement of the damper when it is moved away from the string. A common hammer rail 33 mounted on the piano frame normally supports the hammer 23 in its rest position. A back check 34 provided on the wippen 13 is adapted to receive a catcher 35 provided on the butt immediately after the hammer 23 strikes the string.

The piano action according to this invention is provided with a butt spring means for urging the butt and thus the hammer away from the string. In the embodiment shown in FIGS. 2 and 3A to 3B the damper rail 32 has a plurality of butt leaf springs 36 formed by cutting deep an elongated thin metal, each spring corresponding to each piano action. As shown in detail in FIGS. 3A to 3B, the spring 36 has a substantially L-shaped cross section whose angular portion is provided with an aperture 50. A screw 37 is passed through the aperture 50 and threaded into an internally threaded hole 51 of the damper rail 32 to permit the upper end portion of the spring 36 to be pressure-contacted with the rail 32. The lower portion of the spring 36 extends downward in a substantially vertical direction and is spaced a distance d away from a buffer 39 of the butt 19 so that no spring pressure is applied to the butt during an initial portion of the operation. The distance d may be determined so that the buffer of the butt is abutted against the spring 36 before the jack 16 is disengaged from the butt 19 i.e. immediately before "after touch" occurs. With this embodiment, the distance *d* is 5 to 8 mm or is determined so that when a distance L (46 to 50 mm when the hammer is in a stationary position) between the string 24 and the forward end of the hammer 23 comes to 10 to 20 mm the buffer 39 is abutted against a spring 36. The adjustment of the distance d is roughly effected by turning the screw 37 and finely effected by inserting a tool into a small hole 52 provided in the spring 36 to cause the spring to be bent. Upon adjustment, the distance d is measured by a known gauging device.

The operation of the upright piano action will be explained below. When the player depresses the key K to cause the wippen 13 to be swung upward through the capstan button 14, then the jack 16 is raised by the wippen 13 to cause the butt 19 to be swung, together with the hammer 23, in a counterclockwise direction (FIG. 2). The leaf spring 36 is not abutted against the buffer 39 of the butt until the butt is swung through a predetermined angle i.e. the distance L between the hammer 23 and the string 24 comes to 10 to 20 mm. Then, the jack 16 frictionally slides on the butt skin 20 while continuing to be swung against the gradually increased pressure of the leaf spring 36, and causes the butt to be thrown off when disengaged from the lower surface of the butt. The hammer 23 continues to be swung by an inertia to strike the string 24 and is returned in a clockwise direction by a reaction force of the string and a strong spring force of the leaf spring 36. At this time, the catcher 35 provided on the butt is received by the back check 34. As the key K is released, the wippen 13 is lowered, and the butt 19 is returned by means of the spring 36 in a clockwise direction. During the return stroke of the butt, the butt is disengaged from the spring 36 and the jack 16 is returned to the initial position, where its top end is abutted against the lower portion of the butt, ready for the next succeeding operation.

The function of the butt spring will be more fully described by reference to FIGS. 4 and 5. FIG. 4 shows a relation between the variation of a spring force applied to the butt and the extent to which the key is depressed. A dotted line A indicates a characteristic curve of a conventional upright piano action and a solid line B indicates a characteristic curve of the first embodiment according to this invention. As will be evident from the figure, since with the conventional upright piano action the butt spring normally imparts substantially the same force to the butt, there often occurs that, in a case of rapid, continual strikings of the key, the movement of the jack to the initial position is prevented by the force of the butt spring. Consequently, the string is not struck in accordance with the number of key depressions and the intention of the player can not be fully expressed in a musical performance. With the embodiment according to this invention, on the other hand, the butt spring imparts no force to the butt during the initial part of the string striking stroke and the last part of the return stroke and, once the butt is engaged with the butt spring, the butt spring is allowed to abruptly increase its force according to the key stroke. As a result, the return of the hammer after the string is struck, as well as the return of the butt, can be rapidly effected. Furthermore, when the jack begins to be returned to the original position, the butt spring does not act upon the butt and the jack can be returned assuredly to the initial position.

In FIG. 5 a dotted line X indicates a characteristic curve of a conventional upright piano action; a solid line Y a characteristic curve of the piano action according to this invention; and a dot-dash line Z a characteristic curve of the normal grand piano action. To clarify a difference among these characteristics no load of a damper mechanism for the string is applied to the piano action. The load W is measured by a strain gauge set on the key at a front rail pin position.

A key load W of what is called a "piano touch" is maintained constant, during the first half of the key operation, by a static load. Immediately before the jack causes the butt to be thrown off i.e. the jack begins to slide on the lower surface of the butt, the load W is abruptly increased and after the disengagement of the jack from the butt the load is decreased. As mentioned earlier, the abrupt increase and decrease of this "piano touch" load is called the "after touch". The player senses the magnitude of the "after touch" and controls the strength of a delicate sound.

In the case of the grand piano action Z a rise of the "after touch" is increased to a greater extent due to the fact that the hammer is provided in a horizontal direction and is returned to the rest position due to its weight. For this reason, the strength of a sound is easily and accurately controlled in accordance with the player's intention. In the conventional upright piano action, however, since a hammer load is little applied to the key and the strength of the butt spring is relatively small and constant, a small rise of "after touch" results and the strength of a sound can not be well controlled. To avoid this situation it is considered helpful to increase the force of the butt spring. In this case, since a strong force of the spring is always applied to the butt, the movement of the jack to the initial position is impeded to an appreciable extent and a piano touch load is wholly increased resulting in the undue fatigue on the part of the player.

With the upright piano action according to this invention, since the force of the butt spring can be made sufficiently larger, a greater rise of the "after touch" can be attained and the movement of the jack back to the initial position is not prevented. As will be evident from FIG. 5 the characteristic curve of the upright piano according to this invention is similar to that of the grand piano.

FIG. 6 shows a second embodiment of the piano action according to this invention. With this embodiment a coil spring 54 has one end mounted to the portion 53 of the butt 19 and an abutment member 56 having a relatively hard felt 55 at the lower end portion is suspended from a damper rail 32. When the butt 19 is located in the initial position, the free end of the spring is spaced a distance d away from the felt 55. The spring imparts no force to the butt during the first swinging movement of the butt and acts on the butt halfway, thus attaining the same effect as in the first embodiment.

FIG. 7 shows a third embodiment. With this embodiment a butt 19 is made of a suitable plastic From the upper end of the damper rail side of the butt is projected a plastic leaf spring 57 integral with the butt. An abutment member 59 having a hard felt 58 at its lower end portion is secured through a spacer 60 to the damper rail. When the butt is in the initial position the end of the spring 57 is spaced a distance d away from the felt 58. The butt is not abutted against the felt until the butt is swung through a predetermined angle. Since, with this embodiment, the butt 19 is formed integrally with the spring 57, a manufacture and assembly can be easily effected at low cost.

With the embodiments shown in FIGS. 6 and 7, like the first embodiment, a distance *d* is 5 to 8 mm or determined so that, when the distance between the string and the forward end of the hammer comes to 10 to 20 mm, the spring is abutted against the abutment member.

A fourth embodiment as shown in FIGS. 8A and 8B is the same as the first embodiment except that a butt spring means has an auxiliary spring 41. The auxiliary spring 41 is formed by making two parallel deep cuts in the plate spring and it is bent at the butt 19 side. The auxiliary spring 41 is normally abutted against the butt to cause a force appreciably smaller than that of the main spring 36a, to be applied on the butt. A distance between the main spring **36*a* and the auxiliary spring 41** is preliminarily determined so that when the auxiliary spring is lightly contacted with the butt the main spring is spaced a distance *d*, i.e. 5 to 8 mm, away from the butt.

A dot-dash line C of FIG. 4 shows a relation between a force applied to the butt by the butt spring means as shown in FIGS. 8A and 8B and the extent to which the key is depressed. As will be clear from this figure, the spring means applies at first a very small force to the butt by the auxiliary spring 41 and then applies an abrupt force to the butt midway of the key stroke as in the case of the first embodiment.

Consequently, the return of the jack to an initial position, as well as a great rise of the "after touch" is assured as in the first embodiment. Furthermore, even when the butt is moved away from the main spring **36*a*, the butt can be assuredly returned to the initial position under the influence of the auxiliary spring 41.** The distance d between the butt and the main spring can be accurately adjusted without using any gauge simply by having the auxiliary spring lightly engaged with the butt.

Though with the above-mentioned embodiments the damper rail 32 is utilized as a fixed member secured to the piano frame, the other particular member may be fixed to the piano frame. The butt spring may be leaf spring, compression spring or any other form.

What is claimed is:

1. In an upright piano action including a butt swingably mounted and having a hammer for striking a string, and a jack adapted to be abutted against the butt in accordance with the operation of a key and then thrown off the butt to permit the hammer to be moved from its rest position to a string striking position, the improvement of which comprises main spring means adapted to apply to the butt a force for returning the hammer to the rest position during movement of the hammer between a position other than the rest position and the string striking position and to apply no force to the butt when the hammer is moved from said other position to the rest position, and secondary spring means adapted to apply to the butt a force smaller than that of the main spring means and acting in the same direction as the latter.

2. An upright piano action according to claim 1 in which said main spring means is adapted to apply said force immediately before the butt is thrown off by the jack.

3. An upright piano action according to claim 1 in which a fixed member is further provided and said main spring means is mounted to the fixed member a predetermined distance apart from the butt.

4. An upright piano action according to claim 3 in which said fixed member is a damper rail.

5. An upright piano action according to claim 3 in which said main spring means is a leaf spaced 4 to 7 mm apart from the butt.

6. An upright piano action according to claim 5 in which said secondary spring is a branched portion of the main leaf spring means normally engaged with the butt.

7. An upright piano action according to claim 1 in which said position other than the rest position of the hammer is a position taken when the hammer is spaced 10 to 20 mm apart from the string.

* * * * *